US005887582A

United States Patent [19]

Ban et al.

[11] Patent Number: 5,887,582

[45] Date of Patent: Mar. 30, 1999

[54] VISCOUS FLUID HEATER

[75] Inventors: Takashi Ban; Kenji Takenaka; Shigeru Suzuki, all of Kariya, Japan

[73] Assignee: Kabushiki Kaisha Toyoda Jidoshokki Seisakusho, Kariya, Japan

[21] Appl. No.: 878,008

[22] Filed: Jun. 18, 1997

[30] Foreign Application Priority Data

Jun. 19, 1996 [JP] Japan ..... 8-157956

[51] Int. Cl.[6] ..... A47J 37/00

[52] U.S. Cl. ..... 126/247; 237/12.3 R; 237/12.3 B; 123/142.5 R; 122/26

[58] Field of Search ..... 237/12.3 R, 12.3 B; 122/26; 126/247; 123/142.5 R

[56] References Cited

U.S. PATENT DOCUMENTS 5,573,184 11/1996 Martin ..... 237/12.3 R 5,718,375 2/1998 Gerard ..... 237/12.3 R

FOREIGN PATENT DOCUMENTS

687584A1 12/1995 European Pat. Off. .

*Primary Examiner*—Henry Bennett
*Assistant Examiner*—Derek S. Boles
*Attorney, Agent, or Firm*—Morgan & Finnegan, L.L.P.

[57] ABSTRACT

A viscous fluid type heater is disclosed. The heater has a rotor that is mounted on a drive shaft for integral rotation therewith in a heating chamber. The rotor rotates to shears and heats viscous fluid that is accommodated in a clearance defined between an inner surface of the heating chamber and an outer operation surface of the rotor opposed to the inner surface. The operation surface and the inner surface are formed of different materials. The inner surface and the operation surface has a coating for altering characteristics.

34 Claims, 1 Drawing Sheet

VISCOUS FLUID HEATER

BACKGROUND OF THE INVENTION

1. Field of the Invention

The present invention relates to viscous fluid heaters having rotors that shear viscous fluid to generate heat.

2. Description of the Related Art

Viscous fluid heaters, which are operated by the drive force of automobile engines, have become widely used as an auxiliary heat source. A typical viscous heater is provided with a housing that accommodates a drive shaft and a rotor. The drive shaft is rotated about its axis by the drive force transmitted from the engine. The rotor is operably connected to the drive shaft. The drive shaft and the rotor are located within a heating chamber, which is defined in the housing. In the heating chamber, a slight clearance is provided between the surfaces of a rotor and the opposing walls of the heating chamber.

A viscous fluid (silicone oil is generally used) fills the heating chamber including the clearance. When the rotor is rotated, the viscous fluid surrounding the rotor is moved together with the rotor. The viscous fluid residing in the vicinity of the walls of the heating chamber adheres to the walls. Accordingly, the rotation of the rotor shears the viscous fluid. The shearing action causes friction between the moving and stationary parts of the viscous fluid and generates heat.

In such viscous fluid heaters, it is preferably that the clearance between the rotor surface and the wall surface of the heating chamber be as small as possible to enhance the heating efficiency during shearing of the viscous fluid. However, if the clearance is too small, the rotor may contact and slide against the wall of the heating chamber when rotated. This may cause damage of the rotor and other parts.

SUMMARY OF THE INVENTION

It is a main objective of the present invention to provide a viscous fluid heater having superior durability.

It is a further objective of the present invention to provide a viscous fluid heater that generates heat efficiently.

To achieve the above objectives, the present invention provides a viscous fluid type heater having a rotor that rotates in a heating chamber to shear and heat viscous fluid accommodated in the heating chamber. The heater includes the heating chamber having an inner surface, the rotor having an outer operation surface opposed to the inner surface, the inner surface and the operation surface being formed of materials having different hardness.

Other aspects and advantages of the invention will become apparent from the following description, taken in conjunction with the accompanying drawings, illustrating by way of example the principals of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

Figure 1:
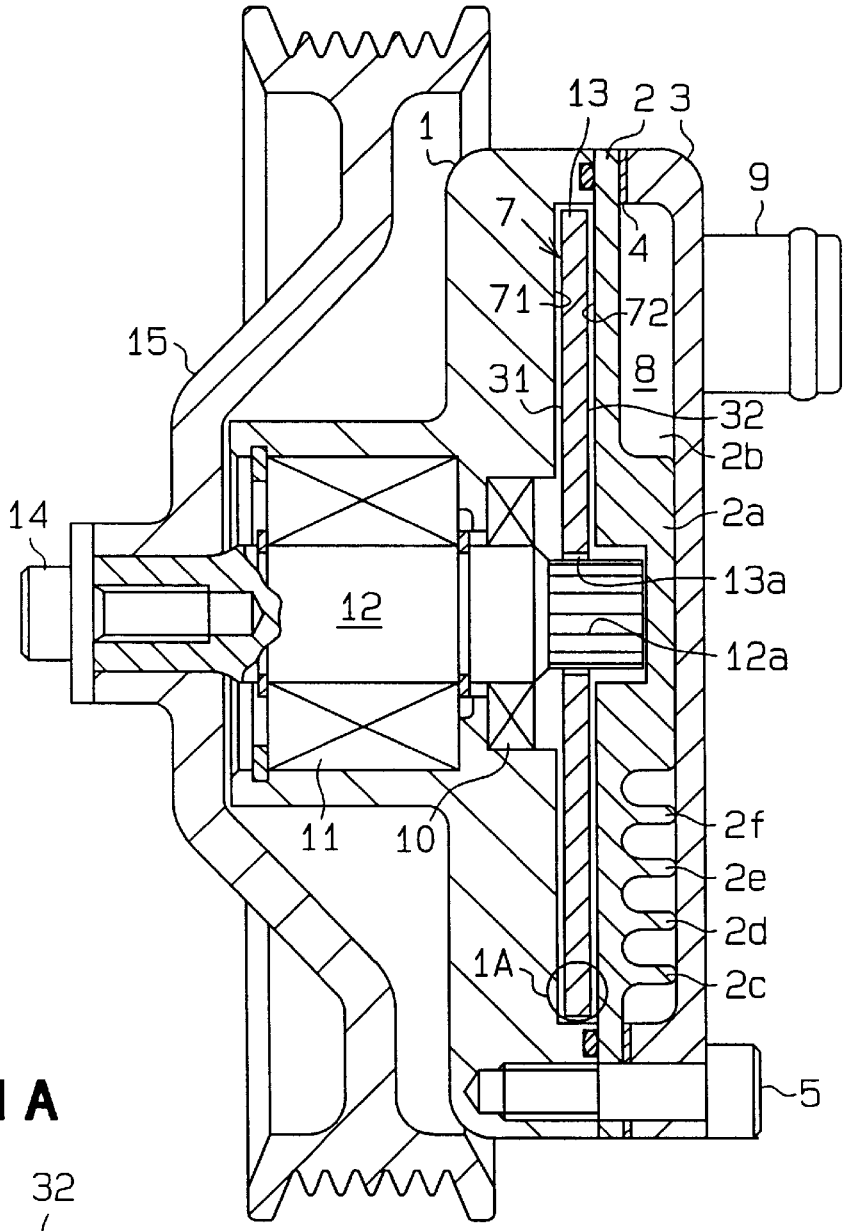
FIG. 1 is a cross-sectional view showing a first embodiment of a viscous fluid heater according to the present invention and FIG. 1A is an enlarged view showing a portion of the heater as indicated by reference numeral 1A in FIG. 1.
Figure 1A:
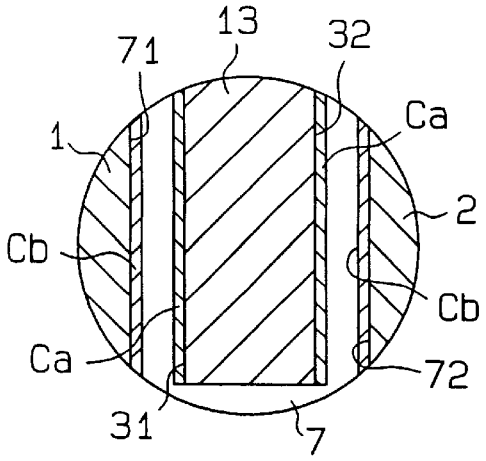

An embodiment of a viscous fluid heater according to the present invention that is incorporated in an automobile heating apparatus will now be described with reference to the drawing.

As shown in FIG. 1, a plurality of bolts 5 (only one is shown) fasten a front housing 1 and a rear housing 3 to each other with a partitioning plate 2 and a gasket 4 arranged in between.

A recess is provided in the rear surface of the front housing 1. The flat inner surface of the recess defines a front chamber wall 71 and the front surface of the partitioning plate 2 defines a rear chamber wall 72. A heating chamber 7 is defined between the front and rear chamber walls 71, 72. More specifically, the chamber walls 71, 72 extend parallel to each other and are spaced away from each other by a predetermined distance. The walls 71, 72 serve as partitions that define the main portion of the heating chamber 7.

A water jacket 8 is defined adjacent to the heating chamber 7 between the rear surface of the partitioning plate 2 and the inner wall of the rear housing 3. An inlet port 9 and an outlet port (not shown) are provided in the rear housing 3. Coolant circulating through a heater circuit of the automobile is drawn into the water jacket 8 through the inlet port 9 and discharged from the water jacket 8 through the outlet port.

A cylindrical projection 2*a* and a partition 2*b* are provided at the rear side of the plate 2. The projection 2*a* is located a the center of the plate 2 while the partition 2*b* extends radially from the projection 2*a* toward the middle of the inlet port 9 and the outlet port. A plurality of fins 2*c*, 2*d*, 2*e*, 2*f* are further provided at the rear side of the plate 2 extending in an arc-like manner about the projection 2*a* from the vicinity of the inlet port 9 to the vicinity of the outlet port. The ends of the projection 2*a*, the partition 2*b*, and the fins 2*c*–2*f* abut against the inner wall of the rear housing 3 and define passages for circulation of the coolant through the water jacket 8 between the inlet port 9 and the outlet port.

A bearing 11 is provided adjacent to the heating chamber 7. A drive shaft 12 is rotatably supported by the bearing 11. Outer splines 12*a* extending axially and parallel to the drive shaft 12 are provided on the rear end of the drive shaft 12. A rotor 13, which is accommodated in the heating chamber 7, is fitted to the drive shaft 12. A bore extends through the center of the rotor 13. Inner splines 13*a* corresponding to the outer splines 12*a* of the drive shaft 12 are provided on the wall of the bore. The inner splines 13*a* cooperatively engage with the outer splines 12*a* to prohibit relative rotation and to permit axial (thrust direction) displacement of the rotor 13 with respect to the drive shaft 12. The rotor 13 has planar front and rear surfaces 31, 32 that are parallel to each other.

An oil seal, or seal 10, is provided in the heating chamber 7 to maintain the heating chamber 7 in a sealed state. The heating chamber 7 is filled with a certain amount of silicone oil (not shown), which serves as the viscous fluid. The silicone oil also fills clearances that are provided between the front surface 31 of the rotor 13 and the front wall 71 of the heating chamber 7 and between the rear surface 32 of the rotor 13 and the rear wall 72 of the heating chamber 7. In this description, viscous fluid refers to any kind of fluid that generates heat when the shearing action of the rotor causes fluid friction. Thus, the viscous fluid is not limited to liquids having high viscosity or semi-fluids such as silicone oil.

A pulley 15 is fastened to the front end of the drive shaft 12 by a bolt 14. A belt (not shown) connects the pulley 15 to an engine of the automobile. Thus, the drive force of the engine is transmitted by the belt to rotate the drive shaft 12. The rotor 13 is rotated integrally with the drive shaft 12. The rotation of the rotor 13 shears and heats the silicone oil included in the space between the front wall 71 of the heating chamber 7 and the front surface 31 of the rotor 13 and between the rear surface 32 of the rotor 13 and the rear wall 72 of the heating chamber 7. Heat exchange takes place between the heated silicone oil and the coolant circulating through the water jacket 8. The heated coolant flows into the heater circuit (not shown) and warms the passenger compartment.

Surface reforming of at least the front and rear surfaces 31, 32 of the rotor 13 is carried out by treating the surfaces 31, 32 to form layers (Ca) or coatings as described hereafter in modes 1 to 6. The same treatment may also be performed on the front and rear chamber walls 71, 72 to form a coatings (Cb).

EXAMPLE 1

The rotor 13 and the front and rear chamber walls 71, 72 are made of steel. The rotor 13, or the treatment subject, undergoes soft nitriding processing, which is a type of surface hardening treatment. Although the front and rear chamber walls 71, 72 are made of the same steel material as the rotor 13, the soft nitriding processing is not carried out on the walls 71, 72. Accordingly, the hardness of the front and rear chamber walls 71, 72 is lower than that of the rotor 13. The soft nitriding processing is carried out in accordance with the Tufftride method by immersing the treatment subject in a cyanic acid solution. A thin layer of iron nitride is formed on the processed surfaces of the rotor 13 (front and rear surfaces 31, 32). A diffusion layer that includes a solid solution of nitrogen and oxygen is formed on the inner side of the thin layer. The iron nitride layer improves the anti-abrasion, anti-seizure, and anti-corrosion properties of the rotor 13, and the diffusion layer enhances the fatigue strength of the rotor 13.

The soft nitriding processing may also be carried out in accordance with a gas soft nitriding method by treating the treatment subject in a mixed atmosphere of a permeable gas, such as carbon monoxide, and ammonia gas to obtain the same advantageous effects. Furthermore, the same advantageous effects may be obtained when performing the soft nitriding treatment on the front and rear chamber walls 71, 72 instead of on the front and rear surfaces 31, 32 of the rotor 13. The soft nitriding treatment may also be performed on the surfaces 31, 32 of the rotor 13 in addition to the walls 71, 72 of the heating chamber 7 to obtain the same advantageous effects.

EXAMPLE 2

The rotor 13 and the front and rear chamber walls 71, 72 are made of aluminum. The rotor 13 undergoes anodic oxide coating processing, which is a type of surface hardening treatment. More specifically, the aluminum plate-like rotor 13, which serves as an anode, is immersed in a solution of sulfuric acid or the like for anodic oxidation. This results in the formation of an aluminum oxide coating on the front and rear surfaces 31, 32 of the rotor 13. The thickness of the aluminum oxide coating is much greater in comparison with oxide coatings that are formed on the surface of aluminum materials through natural oxidation. The aluminum oxide coating increases the surface hardness of the rotor 13 and improves the anti-abrasion and anti-corrosion properties and the like of the rotor 13. The same advantageous effects may be obtained by performing the anodic oxide coating processing on the front and rear chamber walls 71, 72 instead of on the rotor 13. The anodic oxide coating processing may also be carried out on both the rotor 13 and the chamber walls 71, 72 to obtain the same advantageous effects.

EXAMPLE 3

The rotor 13 and the front and rear chamber walls 71, 72 are made of aluminum. The rotor 13 undergoes nickel-phosphorus (Ni-B) electroplating, which is a type of surface hardening treatment, to form a coating of nickel-phosphorus alloy on the front and rear surfaces 31, 32 of the rotor 13. The nickel-phosphorus alloy coating increases the surface hardness of the rotor 13 and improves the anti-abrasion property and the like of the rotor 13. The same advantageous effects may be obtained by performing the nickel-phosphorus electroplating on the chamber walls 71, 72 instead of on the rotor 13. The nickel-phosphorus electroplating may also be carried out on both the rotor 13 and the chamber walls 71, 72 to obtain the same advantageous effects.

EXAMPLE 4

The rotor 13 and the front and rear chamber walls 71, 72 are made of aluminum. The rotor 13 undergoes nickel-boron (Ni-B) electroplating, which is a type of surface hardening treatment, to form a coating of nickel-boron alloy on the front and rear surfaces 31, 32 of the rotor 13. The advantageous effects of mode 3 may also be obtained through this structure and treatment.

EXAMPLE 5

The rotor 13 and the front and rear chamber walls 71, 72 are made of aluminum. The rotor 13 undergoes tin (Sn) plating, which is a type of surface softening treatment, to form a tin coating on the front and rear surfaces 31, 32 of the rotor 13. The tin coating relatively lowers the surface hardness of the rotor 13 and reduces the friction between the surfaces 31, 32 of the rotor 13 and the walls 71, 72 of the heating chamber 7. The same advantageous effects may be obtained by performing the tin plating on the walls 71, 72 of the heat chamber 7 instead of on the rotor 13.

EXAMPLE 6

The rotor 13 and the front and rear chamber walls 71, 72 are made of aluminum. Molybdenum disulfide, which serves as a solid lubricant, is adhered to the front and rear surfaces 31, 32 of the rotor 13 by using polyamideimide resin as a heat resistant adhesive. This forms a coating that is impregnated with molybdenum disulfide on the rotor 13. Molybdenum disulfide decreases the friction coefficient of the rotor surfaces 31, 32 and reduces the friction with the chamber walls 71, 72. The same advantageous effects may be obtained by adhering the solid lubricant on the chamber walls 71, 72 instead of on the rotor 13. The solid lubricant may also be applied to both the rotor 13 and the chamber walls 71, 72 to obtain the same advantageous effects.

In each of the above examples, surface reforming is carried out by forming layers or coatings on the rotor surfaces 31, 32 or on the chamber walls 71, 72. Accordingly, the surface hardness of the rotor surfaces 31, 32 may differ from that of the heating chamber walls 71, 72. Impact produced by the transmission of power to the drive shaft 12 during initiation of operation (especially when employing an electromagnetic clutch) or by insufficient lubrication of the rotor 13 may cause the surfaces 31, 32 of the rotor 13 to contact and slide against the walls 71, 72 of the heating chamber 7. However, in such case, the difference in the hardness of the rotor surfaces 31, 32 and the hardness of the heating chamber walls 71, 72 reduces the friction therebetween. This prevents damage to the rotor 13 and the front housing 1.

Furthermore, the usage of different materials for the rotor surfaces 31, 32 and the surfaces of the heating chamber walls 71, 72 prevents the rotor surfaces 31, 32 and the chamber walls 71, 72 from adhering to one another by frictional heat. Instead of using different materials between the rotor surfaces 31, 32 and the surfaces of the chamber walls 71, 72, the entire bodies of the rotor 31 and the chamber walls 71, 72 may be made of different materials. For example, the rotor 13 may be made of steel while the chamber walls 71, 72 are made of aluminum alloy. Such structure prevents seizure between the rotor 13 and the chamber walls 71, 72.

The rotor surfaces 31, 32, or the surfaces of the chamber walls 71, 72, or both are hardened, softened, or given a lower friction coefficient to improve the anti-abrasion property. This improves the durability of the viscous fluid heater and prolongs the life of the heater.

The above advantageous effects allow the clearance between the rotor surfaces 31, 32 and the associated chamber walls 71, 72 to be smaller. A smaller clearance enables a higher heating value to be obtained.

Although several embodiments of the present invention have been described herein, it should be apparent to those skilled in the art that the present invention may be embodied in many other specific forms without departing from the spirit or scope of the invention. Particularly, it should be understood that the present invention may be embodied in the following forms.

(a) The disk-like rotor 13 may be replaced by a cylindrical rotor. In this case the peripheral surface of the cylindrical rotor corresponds to the rotor surfaces 31, 32.

(b) An electromagnetic clutch mechanism may be employed between the pulley 15 and the drive shaft 12 to selectively transmit the engine drive force to the drive shaft 12 of the viscous fluid heater.

Therefore, the present examples and embodiments are to be considered as illustrative and not restrictive and the invention is not to be limited to the details given herein, but may be modified within the scope of the appended claims.

What is claimed is:

1. A viscous fluid type heater comprising a heating chamber for containing viscous fluid, and a rotor disposed within said heating chamber;

said heating chamber having an inner surface;

said rotor having an outer operation surface for shearing and heating the viscous fluid during rotation of said rotor, said outer operation surface being opposed to said inner surface; and said inner surface and said outer operation surface being formed of metallic materials having different hardnesses.

2. The heater as set forth in claim 1, wherein said inner surface and said outer operation surface are formed of different metallic materials.

3. The heater as set forth in claim 2, wherein at least one of said inner surface and said operation surface has a coating for altering characteristics, and whereby said two surfaces respectively have outside portions formed of the different material.

4. The heater as set forth in claim 3, wherein said coating is formed of an iron nitride.

5. The heater as set forth in claim 4, wherein said coating is formed by a soft nitriding treatment.

6. The heater as set forth in claim 3, wherein said coating is formed of an aluminum oxide.

7. The heater as set forth in claim 6, wherein said coating is formed by an anodic oxide coating treatment.

8. The heater as set forth in claim 3, wherein said coating is formed of one of a nickel-phosphorus alloy and a nickel-boron alloy.

9. The heater as set forth in claim 8, wherein aid coating is formed by one of a nickel-phosphorous plating and a nickel-boron plating.

10. The heater as set forth in claim 3, wherein said coating is formed of a tin.

11. The heater as set forth in claim 10, wherein said coating is formed by a tin plating.

12. The heater as set forth in claim 3, wherein said coating is formed of one of a solid lubricant and a heat resistant adhesive.

13. The heater as set forth in claim 12, wherein said solid lubricant includes a molybdenum disulfide.

14. The heater as set forth in claim 12, wherein said heat resistant adhesive includes a polyamideimide resin.

15. The heater as set forth in claim 1, further including a drive shaft extending in said heating chamber, wherein said rotor is mounted on said drive shaft for integral rotation therewith and relative movement in an axial direction with respect to the drive shaft.

16. A viscous fluid type heater comprising a heating chamber having an inner surface, a rotor disposed within said heating chamber, said rotor having an outer operation surface opposed to said inner surface ;and a drive shaft; wherein said rotor is mounted on said drive shaft for integral rotation therewith in said heating chamber, said inner surface and said outer operation surface defining a clearance therebetween for containing viscous fluid, wherein rotation of said rotor shears and heats the viscous fluid and at least one of said inner surface and said outer operation surface has a coating for altering its characteristics.

17. The heater as set forth in claim 16, wherein said coating is formed of an iron nitride.

18. The heater as set forth in claim 17, wherein said coating is formed by a soft nitriding treatment.

19. The heater as set forth in claim 18, wherein said coating is formed of an aluminum oxide.

20. The heater as set forth in claim 19, wherein said coating is formed by an anodic oxide coating treatment.

21. The heater as set forth in claim 16, wherein said coating is formed of one of a nickel-phosphorus alloy and a nickel-boron alloy.

22. The heater as set forth in claim 21, wherein said coating is formed by one of a nickel-phosphorous plating and a nickel-boron plating.

23. The heater as set forth in claim 16, wherein said coating is formed of a tin.

24. The heater as set forth in claim 23, wherein said coating is formed by a tin plating.

25. The heater as set forth in claim 16, wherein said coating is formed of one of a solid lubricant and a heat resistant adhesive.

26. The heater as set forth in claim 25, wherein said solid lubricant includes a molybdenum disulfide.

27. The heater as set forth in claim 25, wherein said heat resistant adhesive includes a polyamideimide resin.

28. The heater as set forth in claim 16, wherein said rotor is mounted on the drive shaft for relative movement in a axial direction with respect to the drive shaft.

29. A viscous fluid type heater comprising a drive shaft; a heating chamber for containing viscous fluid, said heating chamber having a inner surface; and a rotor disposed within said heating chamber, said rotor being mounted on said drive shaft for integral rotation therewith, said rotor having an outer operation surface opposed to said inner surface, said inner surface and said outer operation surface defining a clearance therebetween for accommodating said viscous fluid, said outer operation surface for shearing and heating the viscous fluid upon rotation of said rotor, said outer operation surface and said inner surface being formed of different metallic materials.

30. The heater as set forth in claim 28, wherein said rotor is mounted on the drive shaft for relative movement in a axial direction with respect to the drive shaft.

31. The heater as set forth in claim 1, further comprising a viscous liquid contained within said heating chamber.

32. The heater as set forth in claim 29, further comprising a viscous liquid contained within said heating chamber.

33. The heater as set forth in claim 16, wherein the altered characteristic is the hardness of said at least one of said inner surface and said outer operation surface.

34. The heater as set forth in claim 16, wherein the altered characteristic is the coefficient of friction of said at least one of said inner surface and said outer operation surface.

* * * * *